United States Patent [19]

Elliott

[11] 4,358,717

[45] Nov. 9, 1982

[54] DIRECT CURRENT POWER SOURCE FOR AN ELECTRIC DISCHARGE LAMP

[75] Inventor: William J. Elliott, Zephyr Cove, Nev.

[73] Assignee: Quietlite International, Ltd., Reno, Nev.

[21] Appl. No.: 159,665

[22] Filed: Jun. 16, 1980

[51] Int. Cl.[3] ..... H05B 41/36

[52] U.S. Cl. ..... 315/308; 315/49; 315/58; 315/179; 315/208; 315/311; 315/DIG. 7

[58] Field of Search ..... 315/49, 51, 58, 179, 315/182, 185 R, 205, 208, 307, 308, 311, DIG. 7

[56] References Cited

U.S. PATENT DOCUMENTS 4,289,993 9/1981 Harper et al. ..... 315/311

*Primary Examiner*—Eugene R. La Roche

*Attorney, Agent, or Firm*—Allegretti, Newitt, Witcoff & McAndrews

[57] ABSTRACT

A solid-state electronic ballast circuit for supplying direct-current power to an electric discharge vapor lamp is disclosed. The source-drain channel of a Vertical Metal Oxide Semiconductor (VMOS) Field Effect Transistor (FET) is connected in parallel with a fixed ballast resistor, the parallel combination being connected in series with the lamp across a DC source. A resistance network controls the conductivity of a bipolar transistor, which in turn controls the conductivity of the VMOS channel, in response to variations in both lamp voltage and current. The ballast circuit may be manufactured as a part of the lamp bulb assembly, the ballast resistor taking the form of an incandescent lamp filament mounted in the same outer bulb with the vapor lamp arc tube. A variable resistance may be employed to manually adjust the level of illumination delivered by the lamp, or a light-sensitive phototransistor may be employed to deliver constant illumination.

32 Claims, 5 Drawing Figures

DIRECT CURRENT POWER SOURCE FOR AN ELECTRIC DISCHARGE LAMP

CROSS-REFERENCE TO RELATED APPLICATION

This application discloses an improvement in the "Direct Current Power Source for an Electric Discharge Lamp" disclosed in co-pending United States application Ser. No. 53,406 filed June 29, 1979 by William J. Elliott and Clarence F. Harper, now U.S. Pat. No. 4,289,993 issued September 15, 1981.

SUMMARY OF THE INVENTION

This invention relates to an improved direct current solid-state ballast for efficiently supplying regulated electrical power to an electric discharge lamp.

In comparison to conventional incandescent (tungsten filament) lamps, electric discharge lamps produce light with much greater efficiency and have a much longer life. As awareness of the need to conserve energy and to reduce maintenance and costs has grown, high intensity discharge (HID) lamps have become the frequent choice over incandescent lamps, particularly to meet industrial, commercial and outdoor lighting needs.

Conventional HID lamps are normally powered by alternating current which flows through an inductive (magnetic core and coil) ballast. The ballast is needed in order to limit the current flow through the negative-resistance discharge lamp. In order to house and support the necessarily large and heavy magnetic ballast, the lamp fixtures and fixture supports themselves must be large and sturdy. Thus, the relatively high overall installation cost of HID lighting systems can be attributed in large part to the cost, size and weight of the conventional AC magnetic ballast.

In the Harper and Elliott U.S. Pat. No. 4,289,393 noted above, a preferred electronic solid-state ballast circuit is disclosed which is smaller, lighter, and less expensive than a conventional core-and-coil ballast and which is capable of efficiently operating an electric discharge vapor lamp during start-up, warm-up and sustained use without generating electromagnetic interference or acoustic vibrations.

In this prior arrangement, the discharge lamp is serially connected with a semiconductor ballast circuit across a source of a direct current potential. The ballast circuit monitors and regulates the flow of power to the lamp by limiting the flow of current to the lamp to a safe value when the lamp is first ignited and thereafer by decreasing the effective resistance of the control circuit as the vapor pressure within the lamp increases, thereby greatly reducing the power dissipated in the ballast circuit during normal operation for increased efficiency. The semiconductor ballast circuit connected in series with the lamp comprises a fixed ballast resistor and one or more transistors connected in parallel. At the time the lamp ignites, the parallel transistor is substantially non-conducting so that substantially all of the lamp current flows through the fixed ballast resistor. As lamp voltage increases and lamp current decreases (due to increasing vapor pressure within the lamp during the warm-up period), means responsive to the lamp's changing operating parameters are employed for increasing the conductivity of the transistor(s), providing a secondary source of current for the lamp, and reducing the effective resistance and power dissipation of the ballast circuit.

While solid-state ballast circuits constructed in accordance with the principles disclosed in the above-noted Elliott and Harper patent have been shown to possess significant advantages, the semiconductor device technology (discrete bipolar) used to instrument the needed function yields a somewhat complex physical device characterized by a substantial number of individual components, and a correspondingly higher cost of manufacture and higher risk of circuit malfunction due to component failure or assembly error.

It is accordingly an object of the present invention to still further reduce the size, cost and comlexity of ballast circuit for use with electric discharge lamps, particularly HID vapor lamps of the type employed in general lighting applications.

It is a related object of the present invention to regulate the power supplied to an electric discharge vapor lamp in response to the lamp's changing operating parameters, and to do so by means of a semiconductor device whose performance characteristics are uniquely adapted to such a task.

In accordance with a principal feature of the present invention, the electrical energy delivered to an electric discharge lamp is advantageously controlled by connecting the lamp across a direct current source in series with the source-drain channel of an insulated gate Field Effect Transistor (FET), the conductivity of the channel being regulated by a control potential applied to the gate control of the FET.

In accordance with a further feature of the invention, the FET preferably takes the form of a Vertical Metal Oxide Semiconductor (VMOS) power transistor in which the channel is "vertically" oriented with respect to the major "horizontal" plane of the semiconductor wafer. Such VMOS devices may be fabricated, in known ways, by etching a V-shaped groove in the surface of a silicon wafer, the vertical (or near vertical) channel being formed along the sides of the groove.

According to still another feature of the invention, the high input impedance and high gain of the VMOS FET allows its channel conductivity to be accurately and reliably controlled, in response to both lamp current and lamp voltage fluctuations, by means of a simplified control circuit which, in a preferred embodiment of the invention, comprises the combination of a resistor (connected in series with the lamp to sense lamp current), a voltage divider (connected in parallel with the lamp to sense lamp voltage), and a single low-power transistor which supplies a control potential to the gate electrode of the FET in order to regulate the lamp's operation.

The improved solid-state ballast circuit contemplated by the present invention may be advantageously fabricated in the form of a single hybrid microelectronic circuit in which the silicon wafer which form the VMOS FET, the bipolar control transistor, and the rectifying diodes in the DC supply, are directly attached to a non-conductive substrate upon which an appropriate pattern of metallic conductors and thin film resistors has been applied. In this way, all of the components of the ballast circuit (with the exception of the fixed ballast resistor and the power supply capacitors) may, in effect, be reduced to a single component which may be readily mass-produced.

In accordance with yet another feature of the invention, the small size of the ballast circuit permits it to be manufactured as an integral part of the lamp itself, the ballast resistor taking the form of a tungsten lamp filament which provides incandescent illumination during the start-up period for the vapor lamp.

In accordance with still another feature of the invention, a manually adjustable resistance may be included in the circuit for controlling the conductivity of the VMOS FET channel to provide means for manually adjusting ("dimming") the level of illumination delivered by the lamp.

According to a further aspect of the invention, a light-sensitive semiconductor may be employed to control the conductivity of the VMOS device in order to regulate the level of illumination present in the vicinity of the lamp.

These and other objects, features and advantages of the present invention will become more apparent through a consideration of the following detailed descriptions of a specific embodiment of the invention.

DESCRIPTION OF THE PREFERRED EMBODIMENT

Figure 1:
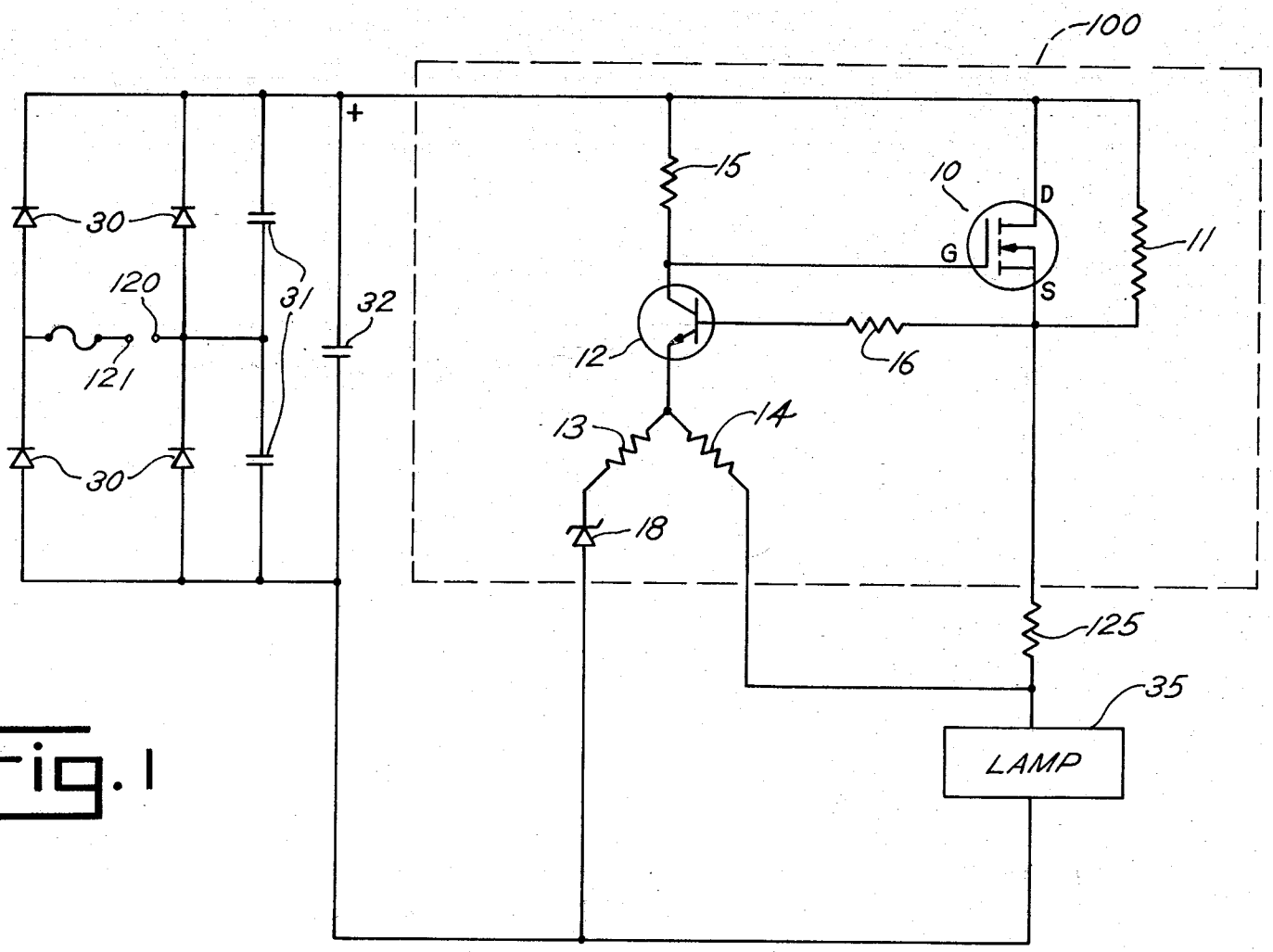
FIG. 1 is a schematic diagram of an improved solid-state ballast which controls the magnitude of energy supplied to an HID lamp and which embodies the principles of the present invention.
Figure 2:
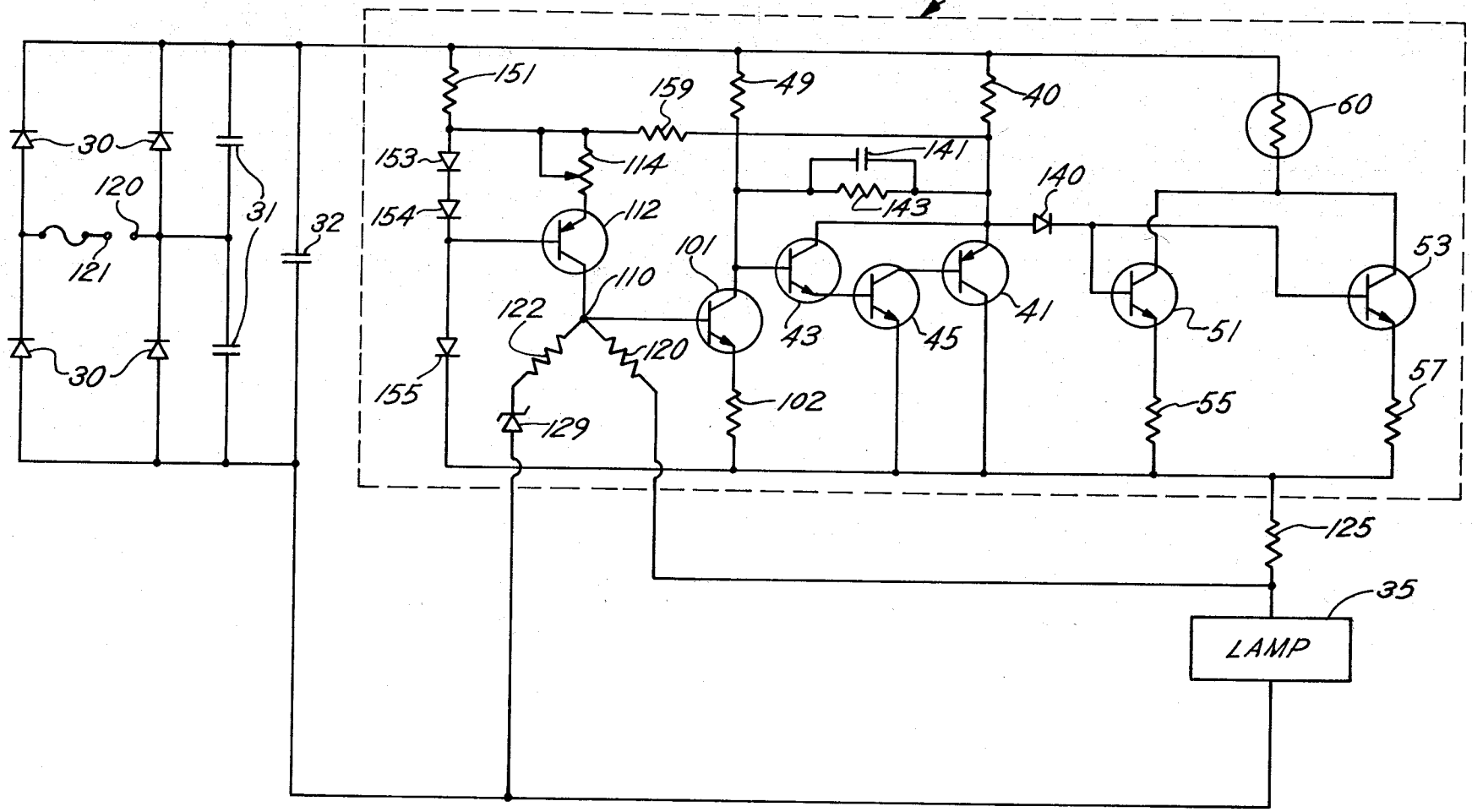
Fig. 2 (PRIOR ART)
FIG. 2 is a schematic diagram of a prior solid-state ballast circuit employing discrete bipolar transistors.

The solid-state ballast circuit shown within the dashed-line rectangle 100 in FIG. 1 represents an improvement over, and a considerable simplification of, the circuit shown within the dashed-line rectangle 100 of FIG. 2. A comparison of FIGS. 1 and 2 will reveal that, in the two circuits, all components outside the rectangle 100 are identical. In the description to follow, the operation of the improved circuit shown in FIG. 1 will be described first, followed by a comparison of the improved circuit with the prior circuit shown in FIG. 2.

The principal active element employed in the improved ballast circuit of FIG. 1 is a Vertical Metal Oxide Semiconductor (VMOS) Field-Effect Transistor (FET) 10 whose source-drain channel is connected between the positive terminal of a DC power supply and one end of a current sensing resistor 125. A fixed ballast resistor 11 is connected in parallel with the channel of FET 10. The gate electrode of FET 10 is connected to the collector of a bipolar transistor 12 whose emitter is connected to the junction of a pair of resistors 13 and 14. The series combination of resistors 13 and 14 forms a voltage divider which is connected in series with a reverse-biased Zener diode across the lamp 35. The collector of transistor 12 and the gate of FET 10 are connected by a resistor 15 to the positive terminal of the DC supply. A resistor 16 connects the base of transistor 12 to the source of FET 10.

The DC supply comprises a conventional full-wave bridge rectifier comprising diodes 30, a pair of voltage doubling capacitors 31 and a filter capacitor 32. When AC line voltage is supplied to the terminals 120 and 121, and before the lamp 35 ignites, the voltage across filter capacitor 32 rises to a value adequate to "fire" lamp 35 (approximtely 300 volts for a mercury vapor lamp). Because of the small capacitance of the doubling capacitors 31 (relative to that of filter capacitor 32), the voltage doubling action ceases as soon as the lamp 36 beings to drain substantial current from the supply.

Immediately after ignition, the voltage across the lamp 35 falls to a low value (e.g. 15 volts). This low initial lamp voltage results from the fact that, in HID lamps, the initial electron flow takes place solely through a starting gas, such as argon. As the lamp continues to burn, its heat begins to vaporize the mercury, sodium or metal hilide which is deposited on the inside walls of the cold arc tube. As the vapor pressure within the tube builds, the voltage across the lamp increases and the current through the lamp decreases.

In order to protect the lamp from excessive current and bring it to a desired operating point, the channel of the FET 10 is initially maintained in a nonconductive state such that substantially all lamp current immediately after ignition flows through the fixed ballast resistor 11. This initial nonconductivity of the FET 10 is ensured by the high starting current flowing through the current sensing resistor 125 which forward biases the base-emitter junction of transistor 12 to hold the gate-to-source voltage of FET 10 at a level well below that required for channel conduction.

The resistance of the fixed ballast resistor 11 is preferably selected to limit initial lamp current to a value approximately equal to 120% of the lamp's rated current at its rated operating voltage.

As lamp voltage increases and lamp current decreases during warm-up, a threshold level is eventually reached where the bipolar transistor 12 begins to be turned off, raising the potential applied to the gate electrode of FET 10 and causing the source-drain channel of FET 10 to become conductive. As current begins to flow through the channel of the FET 10 as well as through resistor 11, additional current flow through resistor 125 has a tendency to turn ON transistor 12 and turn FET 10 OFF. Thus, the combined gain of transistors 12 and FET 10 operate in a negative feedback relationship to regulate the lamp current after the threshold level is reached.

Because of manufacturing variations, different lamps of the same type actually operate at different voltages and currents when fully heated. In order to standardize the amount of illumination obtained, it is desirable to deliver a predetermined, rated level of power to such lamps, nothwithstanding variations in their operating voltages. To accomplish this, the solid-state ballast circuit is also made responsive to variations in lamp voltage. The voltage-divider action of resistors 13 and 14 produces an offset voltage across resistor 14 which, in effect, shifts the lamp current threshold level to a lower value for lamps exhibiting a higher operating voltage. Until lamp voltage exceeds the reverse breakdown voltage of Zener diode 18, lamp voltage has no effect on the conductivity of the FET 10 which, after it first becomes conductive, provides constant current to the lamp 35. Once diode 18 conducts, however, further increases in lamp voltage reduce the regulated threshold level of lamp current such that, in the vicinity the lamps' rated operating voltage (at full vapor pressure), the circuit assures the delivery of a rated level of power to the lamp.

It should further be noted that the ballast circuit regulates the delivery of power to the lamp solely in response to the operating condition of the lamp itself,. and is independent of line voltage fluctuations which, in commercial power systems, may be expected to vary from 108 to 132 volts AC.

To deliver substantially constant power to the lamp for a standardized level of illumination, the relative values of resistors 13, 14 and 125 are selected such that, at the lamps rated operating point, any decrease in lamp voltage is compensated for by an increase in lamp current (and vice-versa). For example, to operate type H39 175-watt mercury vapor lamps, the following components and values are suitable:

VMOS FET 10—VN034ON1 (available from Supertex, Inc. of Sunnyvale, California)
Resistor 11—85 ohms, 100 watt
Transistor 12—Type 3904 NPN bipolar transistor
Resistor 13—180 Kohms, ¼watt
Resistor 14—50 ohms, ¼ watt
Resistor 15—100 Kohms, ¼ watt
Resistor 16—200 ohms, ¼ watt
Diode 18—100 volts, 1 watt
Capacitor 31—5 microfarads, 200 volts AC
Capacitor 32—240 microfarads, 350 volts
Lamp 35—H39 mercury vapor
Resistor 125—5 ohms, 5 watts The VMOS FET 10 possesses properties which make it uniquely suited to the task of controlling current through an electric discharge lamp. First, insulated gate field effect transistors, which operate on different physical principles from bipolar transistors, possess a very high input impedance, allowing them to be driven by very low power control devices. The planar Metal Oxide Semiconductor (MOS) type of Field-Effect Transistor though widely used in the construction of complex integrated circuits, exhibits a high ON-state voltage, making the standard MOSFET unsuitable for controlling large amounts of current. As a result, bipolar devices have been the frequent choice for such high power applications. The relatively recent development of the new family of VMOS devices, constructed so that the channel current flows substantially vertically with respect to the major horizontal plane of the wafer, allows the ratio of channel length to channel width to be greatly reduced for markedly improved current handling ability.

The prior ballast circuit using bipolar power-transistors is shown in FIG. 2 of the drawings (from Elliott and Harper U.S. Pat. No. 4,289,993) and illustrates, by comparison, the advantageous properties of utilizing a VMOS FET as the principal active lamp ballasting element.

First, as shown in FIG. 2, a pair of parallel bipolar power transistors 51 and 53, protected by termistor 60, were previously employed to bypass the ballast resistor 40. Two bipolar transistors (in comparison to the single VMOS device 10) were required to handle the large currents involved, and emitter resistors 55 and 57 were needed to prevent "current hogging" by one of the bipolar transistors, a problem made worse by the fact that bipolar devices are subject to "thermal runaway" and "secondary breakdown." In contrast, in the VMOS FET of FIG. 1, increases in temperature do not increase the conductivity of the device and secondary breakdown does not occur.

Next, substantial base current drive to the power transistors 51 and 53 is required in the prior device of FIG. 2, resulting in the need for a number of cascaded transistors in the control circuit to achieve the needed gain. As the number of cascaded transistors increased, the potential cumulative effect of manufacturing variations in gain (beta) of the transistors required the inclusion of still further amplification with negative feedback to achieve reliable operation. In all, the prior ballast circuit, using discrete bipolar devices as shown in FIG. 2, required a total of 25 individual components as seen (within the dashed-line rectangle 100 of FIG. 2) while the improved circuit of FIG. 1 requires only eight components and, as noted earlier, even these are suitable for combination into a single, hybrid microelectronic device. Thus, the high input impedance, high gain, and high current-handling capability of the VMOS FET all contribute to the simplification of the circuit and further reduce its size, cost and weight.

Figure 3:
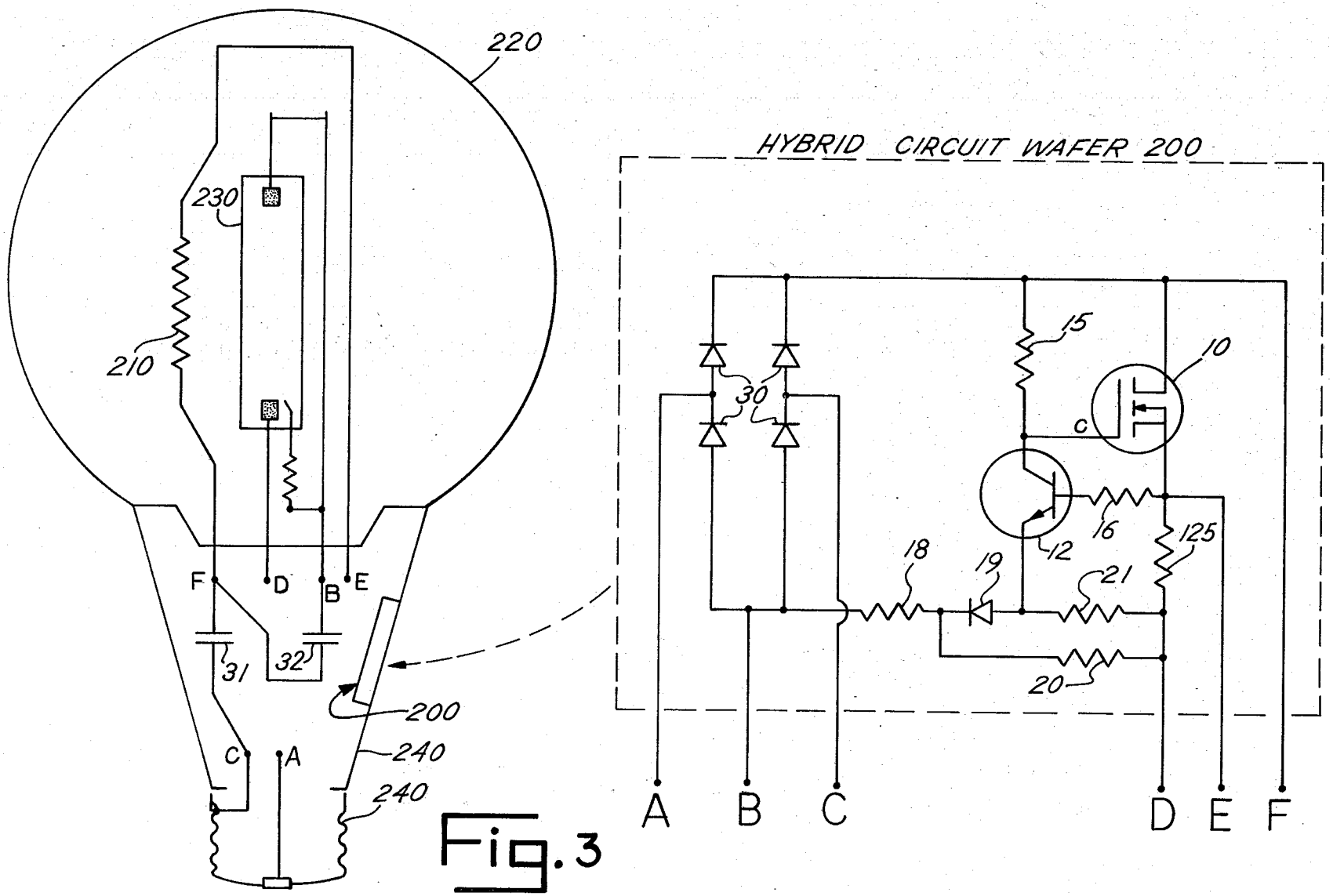
FIG. 3 depicts a "self-ballasted" HID lamp in which the ballast circuit is housed within the lamp's neck section and the ballast resistor comprises an incandescent lamp filament which, together with the HID arc tube, is supported within an outer glass bulb.

In accordance with a further aspect of the invention, the small, low-cost ballast circuit may advantageously be constructed as an integral part of the lamp bulb assembly as shown in FIG. 3 of the drawings. The principle electronic components of the ballast may, as noted earlier, be fabricated in the form of a single hybrid circuit 100 shown schematically at the right in FIG. 3, and positioned in the neck of the bulb assembly shown diagramatically at the left in FIG. 3.

The various components of the circuit operate as previously discussed, and have been indicated with the same reference numerals used in FIG. 1. In the hybrid circuit shown in FIG. 3, the voltage sensing circuit has been modified to eliminate the need for the comparatively expensive high-voltage Zener diode 18 shown in FIG. 1. Diode 18 and resistors 13 and 14 are replaced by the series combination of resistors 18 and 20 connected across the lamp (between terminals B and D), a forward-biased diode 19 connected from the emitter of transistor 12 to the junction of resistors 18 and 20, and a resistor 21 which connects the emitter of transistor 12 to terminal D (the junction of the current sensing resistor 125 and the arc tube 230). Only a fraction of the lamp voltage appears across resistor 20, so that diode 19 does not become forward biased until the potential across arc tube 230 nears its normal operating level.

The hybrid circuit 200 is fabricated, in known ways, by plating and electrically non-conductive substrate (such as a ceramic, silicon, or beryllia) with a metallized pattern of conductors to which the semiconductor device wafers (the VMOS FET 10, the bipolar transistor 12, and the diodes 30) are connected. The resistors 13–15 and 125 take the form of semiconductor or deposited film devices. Using one of several trimming techniques (oxidation, annealing, laser trimming or abrasion), the absolute value tolerances of film resistors can be trimmed to within 1 to 0.01% of the desired value. In this way, the relationship between the values of resistors 13, 14 and 125 can be accurately adjusted such that the hybrid circuit 200 delivers the desired power level to the HID arc tube.

In the arrangement shown in FIG. 3, the function of the fixed ballast resistor 11 shown in FIG. 1 is assumed by a 200 watt tungsten filament, indicated at 210 in FIG. 3, within the outer glass bulb 220 of the lamp. The bulb 220, which is partially evacuated and/or filled with an inert gas to prevent the filament 210 fro oxidizing, also contains the quarts arc tube 230 which forms the mercury vapor discharge lamp portion of the assembly. The filament 210, the bulb 220, and the arc tube 230 are each of conventional construction. Electrical connection to the AC power source is established through a standard screw-type lamp base 240. The reference letters A through E in FIG. 3 indicate the manner in which the lamp elements within the bulb 230 are interconnected with the hybrid circuit wafer 200, the AC power applied to base 240, and the filter capacitor 32 and voltage doubling capacitor 31. (Note that only one voltage doubling capacitor is used.)

Using the integrated ballast and lamp construction illustrated in FIG. 3, direct conversion of inefficient incandescent lighting fixtures to HID lighting is possible without any modification of the fixture itself. The old incandescent bulb is merely replaced with the more efficient, more luminous and longer-lived HID lamp. The starting filament 210 provides added light during the start-up period of the HID arc tube 230 while it protects the tube against damaging currents and dissipates the ballast resistance heat by radiation. The outer jacket 240, to which the hybrid circuit 200 is thermally attached, surrounds the neck of the lamp assembly and acts as a heat sink to prevent high temperature build-up. Alternatively, the hybrid circuit may be used to power the combination of conventional incandescent and HID lamps in separate bulbs, in either common or separate fixtures, the incandescent lamp being lit only during start-up.

It is to be understood that the arrangements which have been described are merely illustrative of one application of the principles of the present invention. Numerous modifications may be made to the specific ballast circuit and lamp constructions disclosed without departing from the true spirit and scope of the invention.

Figure 4:
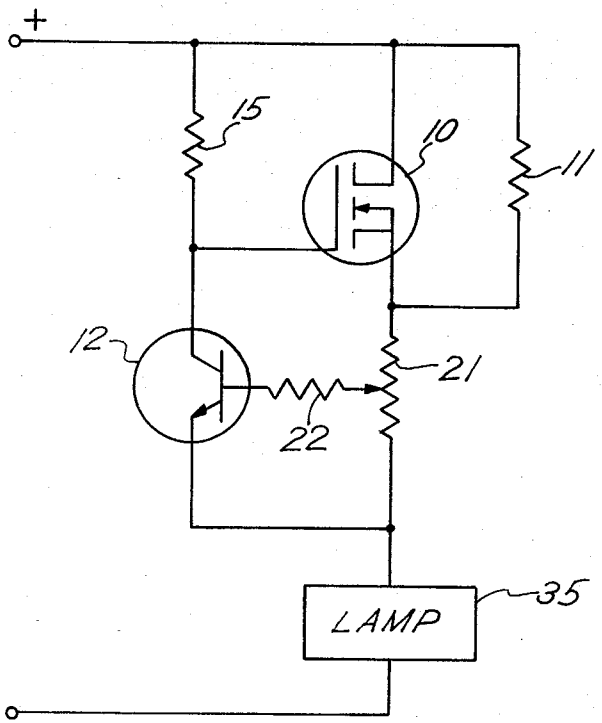
FIG. 4 is a schematic diagram of a solid-state, dimmable ballast which embodies the principles of the present invention.

The principles of the present invention may be employed to construct a solid-state ballast including means for manually adjusting the level of illumination delivered by an HID vapor lamp. FIG. 4 of the drawings showns one such arrangement. The circuit is similar to those discussed earlier in conjunction with FIGS. 1 and 3, and includes the bipolar transistor 12 which controls the channel conductivity of FET 10 which is connected in parallel with the fixed ballast resistance 11. (As noted earlier in connection with the discussion of FIG. 3, resistance 11 may take the form of an incandescent filament.) However, the voltage sensing elements of the control circuits discussed earlier are eliminated in the arrangement shown in FIG. 4, and the fixed current sensing resistor 125 is replaced by a manually adjustable potentiometer 21. A resistor 22 connects the "wiper" of potentiometer 22 to the base of the transistor 12 whose emitter is directly connected to the positive side of lamp 35.

With the potentiometer 21 set to provide rated operating current to the lamp 35, FET 10 remains nonconductive as the lamp 35 warms immediately after ignition. When the current through potentiometer 22 drops to the threshold level, transistor 35 begins to turn OFF and FET 10 begins to turn ON. Thereafter, the circuit shown in FIG. 4 maintains a constant current through the lamp 35 as it completes the warmup period and comes to full vapor pressure.

During normal operation, if the potentiometer 21 is adjusted to increase the current-sensing resistance between the base of transistor 12 and the lamp 35, a smaller amount of lamp current will provide the same net forward bias to the transistor 12. As a result, lamp current can be adjusted over a significant range to control the level of illumination delivered by the lamp. Once the lamp has reached full vapor pressure, lamp voltage remains substantially constant as lamp current is decreased to dim the lamp. Thus, as current through the lamp is decreased by reducing the conductivity of FET 10, the amount of power dissipated by FET 10 decreases as well.

Figure 5:
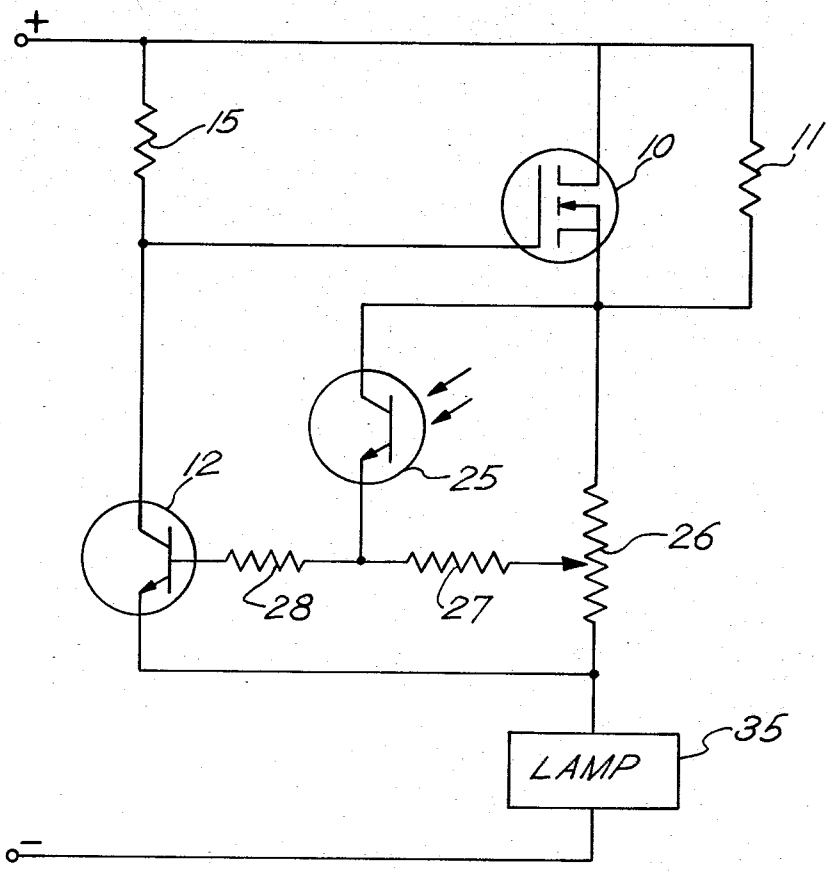
FIG. 5 is a schematic diagram of a constant-illumination ballast employing a phototransistor responsive to the level of illumination in the vicinity of the lamp for controlling the conductivity of the VMOS channel.

Since the ballast circuit contemplated by the present invention is capable of controlling the level of illumination delivered by the lamp, a light-responsive semiconductor can be incorporated into the control circuitry such that the level of illumination in the vicinity of the lamp can be regulated. FIG. 5 of the drawings shows an example of such a device using a phototransistor 25 connected to control the conductivity of the source-drain channel of FET 10. In the arrangement shown in FIG. 5, a potentiometer 26 is serially connected with the source-drain channel of FET 10 and the lamp 35. The wiper of potentiometer 26 is connected to the base of bipolar transistor 12 by means of the series combination of resistors 27 and 28. The collector-emitter path of a phototransistor 27 is connected between the source terminal of FET 10 and the junction of resistors 27 and 28.

As in the case of the circuits discussed earlier, the initially high lamp current following ignition keeps transistor 12 ON and FET 10 OFF until lamp 35 is heated. With the potentiometer 26 set to deliver the desired level of illumination, any decrease in the light level sensed by phototransistor 25 decreases the forward-bias applied to transistor 12, tending to turn that transistor ON and to turn FET 10 OFF. Similarly, any increase in the level of illumination sensed by phototransistor 25 will tend to reduce the magnitude of illuminating current supplied to lamp 35. Phototransistor 25 may take the form of a NPN planar silicon phototransistor (such as the General Electric type L14H3) which acts essentially as a constant current device delivering a current which is directly related to detected light intensity. For example, the current delivered by the G.E. Type L14H3 varys from about 0.1 ma. at an illumination of 2 mw./cm$^2$ to about 1.2 ma. at 20 mw./cm$^2$.

A light-intensity responsive HID ballast arrangement of the type illustrated in FIG. 5 may be arranged to insure constant illumination output from the lamp as its efficiency declines by optically coupling the phototransistor directly to the lamp. Alternatively, the phototransistor may be shielded from direct radiation by the lamp such that it is instead responsive to ambient room light. Fiberoptic light pipes may be used to direct light from the desired location to the phototransistor. With the latter arrangement, the lamp would automatically dim when roomlight is partially supplied by sunlight, and automatically brighten again in the evening or in cloudy periods. If lamp current decreases below the level needed to keep the lamp heated, the lamp will self-extinguish, and additional photosensitive means (not shown) may be employed for preventing the lamp from being re-ignited unless the level of ambient illumination is below a predetermined level. In this way, the control circuit according to the present invention by be employed, for example, to control the operation of indoor and outdoor lights which are automatically turned ON, vary their brightness to meet varying illumination needs, and automatically turn OFF when no illumination at all is required.

What is claimed is:

1. A power supply for an electric discharge vapor lamp comprising, in combination, a source of a direct current potential, a ballast resistor, a VMOS insulated-gate field effect transistor having a gate electrode and a source-drain channel, first circuit means for serially connecting said channel and said vapor lamp across said source, second circuit means for connecting said ballast resistor in parallel with said channel, and regulating means responsive to variations in the magnitude of electrical energy delivered to said lamp for varying the potential applied to said gate electrode to control the conductivity of said channel.

2. A power supply as set forth in claim 1 wherein said regulating means includes means for varying the potential applied to said gate electrode to increase the conductivity of said channel whenever the current flowing through said lamp falls below a threshold level.

3. A power supply as set forth in claim 2 including means for shifting said threshold level to a lower current magnitude in response to increasing lamp voltage.

4. A power supply as set forth in claim 3 wherein said regulating means includes a resistance connected in series with said lamp for detecting the magnitude of current flowing through said lamp.

5. A power supply as set forth in claim 4 wherein said regulating means further includes means for detecting the magnitude of voltage across said lamp.

6. An arrangement as set forth in claim 1 wherein said means for varying the potential applied to said gate further includes a light sensitive semiconductor responsive to the level of illumination in the vicinity of said lamp for maintaining said level substantially constant.

7. An arrangement as set forth in claim 1 wherein said means for varying the potential applied to said gate further includes manually adjustable means for varying said potential to vary the current through said lamp after it has been heated to substantially full vapor pressure to thereby control the level of illumination produced by said lamp.

8. A ballast circuit for connecting a high intensity discharge lamp to a source of direct current energy comprising, in combination, a VMOS insulated-gate field effect transistor having a gate-electrode and a source drain channel, a fixed ballast resistor connected in parallel with said channel, a current sensing resistor for connecting the parallel combination of said channel and said ballast resistor in series with said lamp, a voltage sensing resistance connected to said lamp, and a control transistor having an input circuit connected to said sensing resistors and having an output circuit connected to the gate of said field effect transistor.

9. A ballast circuit as set forth in claim 8 wherein said control transistor varies the potential applied to said gate to increase the conductivity of said channel in response to increasing vapor pressure within said HID lamp.

10. A self-ballasted HID lamp comprising, in combination, an electric discharge vapor arc tube and a tungsten filament mounted within a glass bulb, a VMOS insulated-gate field-effect transistor transistor having a control electrode and a transconductive path, circuit means for connecting said transconductive path in series with said arc tube and in parallel with said filament, and means connected to said control electrode for increasing the conductivity of said transconductive path in response to increases in the vapor pressure within said arc tube.

11. A lamp as set forth in claim 10 including a lamp base attached to said glass bulb by means of a neck section, said base including exterior conductive electrical contact means for establishing an electrical connection to a power supply socket, and means for mounting said transistor within said neck section.

12. A self-ballasted lamp comprising, in combination, a glass bulb, a lamp base having external conductive contact means adapted to establish electrical connections to an alternating current power supply socket, a neck section attaching said bulb to said base, an electric discharge vapor arc tube mounted within said bulb, a resistive filament adapted to be heated to incandescence mounted within said bulb, and an electronic control circuit mounted within said neck section, said control circuit comprising, in combination, a rectifier having an input circuit connected to said conductive contact means and an output circuit forming a source of a direct current potential, a transistor having a control electrode and a transconductive path, circuit means for connecting said transconductive path in series with said arc tube across said source, circuit means connecting said filament in parallel with said transconductive path, and means connected to said control electrode and responsive to the magnitude of electrical energy delivered to said arc tube for controlling the conductivity of said transconductive path.

13. A lamp as set forth in claim 12 wherein said transistor is a vertical metal oxide semiconductor insulated-gate field effect transistor.

14. A power supply as set forth in claims 12 or 13 wherein said means connected to said control electrode further includes a light sensitive semiconductor responsive to the level of illumination in the vicinity of said lamp for controlling the conductivity of said transconductive path.

15. A lamp as set forth in claim 11 wherein said means for controlling the conductivity of said transconductive path includes means for maintaining said path nonconductive until the current through said arc tube falls to a threshold current level.

16. A power supply as set forth in claim 13 including manually adjustable means for varying said threshold level to control the level of illumination delivered by said lamp.

17. A lamp as set forth in claim 15 wherein said means for controlling the conductivity of said transconductive path further includes means responsive to the voltage across said arc tube for altering the value of said current threshold level to deliver a predetermined rated level of electrical power to said arc tube.

18. An improved power supply for operating an electric vapor discharge lamp comprising, in combination, a source of a direct-current potential, a vertical Metal Oxide Semiconductor Field Effect Transistor (MOSFET) having a source-drain channel and a gate electrode, means connecting said source-drain channel in series with said lamp across said source, and means for supplying a control potential to said gate electrode to increase the conductivity of said source-drain channel in response to increases in the vapor pressure in said lamp as it is heated following ignition.

19. A power supply as set forth in claim 18 wherein said means for supplying a control potential to said gate electrode comprises a current sensing resistor serially connected with said lamp and a transistor connected between said current sensing resistor and said gate electrode for increasing the conductivity of said channel in response to decreases in the magnitude of current flowing through said lamp as vapor pressure increases.

20. A power supply as set forth in claim 19 including a ballast resistor connected in parallel with said source-drain channel.

21. A power supply as set forth in claim 20 wherein said ballast resistor comprises an incandescent lamp filament.

22. A power supply as set forth in claims 18 or 19 or 20 wherein said means for supplying a control potential to said gate electrode includes a manually variable resistance for adjusting the level of illumination produced by said lamp.

23. A power supply as set forth in claims 18 or 19 or 20 wherein said means for supplying a control potential to said gate electrode further includes a light sensitive semiconductor responsive to the level of illumination in the vicinity of said lamp for regulating the conductivity of said source-drain channel after said vapor pressure has increased to substantially its full normal operating value.

24. A solid-state ballast circuit for supplying power to a high intensity discharge lamp from a source of an electrical potential which comprises, in combination, a Vertical Metal Oxide Semiconductor Field Effect Transistor (VMOS FET) having a source-drain channel and a gate electrode, a current sensing resistor serially connected with said lamp across said source, a fixed resistor connected in parallel with said channel, a bipolar transistor having a collector-emitter path and a base-emitter path, means connecting said base-emitter path in parallel with said current sensing resistor, and means connecting said collector-emitter path to said gate electrode to control the conductivity of said channel.

25. A solid-state ballast circuit as set forth in claim 24 including means for varying the effective resistance of said current sensing resistance for varying the amount of illumination delivered by said lamp.

26. A solid-state ballast as set forth in claim 25 wherein said means for varying the effective resistance of said current-sensing resistor comprises a manually adjustable resistance.

27. A solid-state ballast circuit as set forth in claim 24 further including a light-sensitive semiconductor operatively connected to said base-emitter path and responsive to the level of illumination in the vicinity or said lamp for regulating said level of illumination.

28. A solid-state power supply as set forth in claim 24 including means responsive to the voltage across said lamp for varying the current in said base-emitter path for regulating the magnitude of power delivered to said lamp.

29. A solid-state power supply for a high intensity discharge lamp which comprises, in combination, a fixed resistance connected in series with said lamp for limiting the amount of current flowing through said lamp after said lamp is first ignited and before said lamp is heated to its normal operating vapor pressure, a VMOS field-effect transistor having its source-drain channel connected in parallel with said fixed resistance, and a control circuit responsive to the magnitude of current flowing through said lamp for increasing the conductivity of said channel whenever said magnitude of current falls below a predetermined threshold level.

30. A solid-state power supply as set forth in claim 29 including means for reducing the value of said predetermined threshold level in response to increases in the operating voltage across said lamp.

31. A solid-state power supply as set forth in claim 29 including a manually adjustable resistance for varying the value of said threshold level.

32. A solid-state power supply as set forth in claim 29 including a light-sensitive semiconductor connected to vary the conductivity of said source-drain channel in response to variations in the intensity of illumination in the vicinity of said lamp for maintaining said intensity a substantially constant.

* * * * *